US007285082B1

(12) United States Patent
Walker

(10) Patent No.: US 7,285,082 B1
(45) Date of Patent: Oct. 23, 2007

(54) AIRTIGHT BOX WITH MANUFACTURING METHOD AND APPARATUS

(75) Inventor: Stephen Walker, Edinburgh (GB)

(73) Assignee: Crystal B.V., Almere (NL)

( * ) Notice: Subject to any disclaimer, the term of this patent is extended or adjusted under 35 U.S.C. 154(b) by 0 days.

(21) Appl. No.: 10/220,270

(22) PCT Filed: Mar. 8, 2000

(86) PCT No.: PCT/NL00/00151

§ 371 (c)(1),
(2), (4) Date: Dec. 30, 2002

(87) PCT Pub. No.: WO01/66425

PCT Pub. Date: Sep. 13, 2001

(51) Int. Cl.
*B31B 1/24* (2006.01)

(52) U.S. Cl. ..... 493/87; 493/56; 493/63; 493/84; 493/150; 229/219

(58) Field of Classification Search ..... 493/52, 493/56, 58, 59, 62, 63, 67, 68, 74, 84, 93, 493/94, 95, 96, 128, 87, 130; 229/117.31, 229/123.2, 210, 214–219, 117.3
See application file for complete search history.

(56) References Cited

U.S. PATENT DOCUMENTS

| | | | | | |
|---|---|---|---|---|---|
| 2,731,188 | A * | 1/1956 | Alden | 229/213 |
| 3,426,955 | A | 2/1969 | Olson | |
| 3,768,719 | A * | 10/1973 | Johnson | 229/117.3 |
| 4,398,900 | A * | 8/1983 | Wise | 493/62 |
| 4,421,236 | A * | 12/1983 | Lowe | 229/231 |
| 4,548,593 | A * | 10/1985 | Tisma | 493/56 |
| 4,565,315 | A | 1/1986 | Wagner et al. | |
| 4,581,008 | A * | 4/1986 | Reil | 493/363 |
| 4,604,850 | A * | 8/1986 | Reil | 53/423 |
| 4,740,163 | A * | 4/1988 | Kuchenbecker | 493/56 |
| 4,795,513 | A | 1/1989 | Jensen, Jr. | |
| 4,838,009 | A * | 6/1989 | Connor et al. | 53/477 |
| 5,050,742 | A * | 9/1991 | Muckenfuhs | 206/494 |
| 5,165,568 | A * | 11/1992 | Wischusen, III | 229/164.1 |
| 5,201,698 | A * | 4/1993 | Kobayashi | 493/87 |
| 5,392,589 | A * | 2/1995 | Buchanan | 53/412 |
| 6,059,182 | A * | 5/2000 | Wein | 229/219 |
| 6,145,736 | A * | 11/2000 | Ours et al. | 229/117.3 |
| 6,203,482 | B1 * | 3/2001 | Sandford | 493/61 |
| 6,234,943 | B1 * | 5/2001 | Copin | 493/11 |
| 6,386,438 | B1 * | 5/2002 | Walsh et al. | 229/117.27 |
| 6,634,546 | B2 * | 10/2003 | Heeley et al. | 229/222 |
| 6,676,584 | B2 * | 1/2004 | Tachikawa et al. | 493/70 |
| 2002/0052275 | A1 * | 5/2002 | Walsh | 493/52 |

FOREIGN PATENT DOCUMENTS

| | | |
|---|---|---|
| EP | 0 072 931 | 3/1983 |
| GB | 1 567 592 | 5/1980 |
| WO | 97 32788 | 9/1997 |

* cited by examiner

*Primary Examiner*—Christopher Harmon
(74) *Attorney, Agent, or Firm*—Oblon, Spivak, McClelland, Maier & Neustadt, P.C.

(57) ABSTRACT

A method, apparatus for practicing the method, and article manufactured by the method in which a block is cut out with side wall and end wall panels, the end wall panels attached to the side wall panels via end wall fold lines. The box includes a pour opening. Recesses are provided in at least one of the end wall panels for exposing adhesive for attaching the flexible material strip to the corresponding end wall panel.

10 Claims, 7 Drawing Sheets

AIRTIGHT BOX WITH MANUFACTURING METHOD AND APPARATUS

BACKGROUND OF THE INVENTION

Field of the Invention

The present invention relates to several methods, to a box manufactured therewith, to corresponding apparatus, and to programmable control means and software for performing said method.

SUMMARY OF THE INVENTION

One aspect of the invention relates to a method for manufacturing a box, for example, from cardboard, wherein a blank P is cut out which comprises side wall panels which are mutually interconnected through side wall fold lines, and end wall panels which are attached to the side wall panels via respective end wall fold lines; where the end wall panels are bounded by two opposite free edges and a free end wall edge located opposite the respective end wall fold lines; wherein a flexible material strip S is attached at least to end wall panels through bonding; wherein recesses are provided in at least one end wall panel for exposing adhesive Gv for the purpose of attaching the material strip S to the corresponding end wall panel, and adhesive for the purpose of interconnecting the end wall panels, said adhesives are in communication at the recesses; and wherein a pour opening is provided in the box.

Such a method is known from applicants International application published under WO 97/32788. The known method describes how an airtight box can be manufactured in mass production. As described the box may be provided with a dispensing or pour opening known per se in the prior art. It is however not self evident how to design such a pour opening in a way wherein its mere presence does not lead to a substantial adverse influence on the rigidity and air tightness of the box, while at the same time the pour opening will have to openable conveniently.

Therefore it is an object of the present invention to provide in particular a method and apparatus for manufacturing a box, specifically an airtight box having features for creating an easily operable opening, capable of being mass produced.

Thereto the method according to the present invention is characterised in that at the place of the pour opening the cardboard and the material strip S are pre-weakened and that at least a part of the pre-weakened sections is offset in space relative to each other. It is an advantage of the method according to the invention that the pre-weakening of the areas for creating the opening in the cardboard and the material strip does not jeopardise the airtightness features of box, because the pre-weakened sections are spatially displaced or offset. In particular if the material strip is perforated the perforation will locally be adhered to and sealed to the inner side of the surrounding cardboard. For example if the cardboard outer or reverse side/sides is/are perforated or partially cut the thus formed pre-weakened section is spatially offset relative to the pre-weakened section in the material strip and therefore the combination of closely related mechanically weakened sections provide possibilities for conveniently manually tearing and shaping those sections in order to form a well and pre-defined pour opening.

Another also independent embodiment of the method according to the present invention is characterised in that some of the above mentioned recesses are offset away from their corresponding end wall fold line such that an end wall fold line area A is defined, wherein the pour opening is provided. Lines of adhesive connecting these recesses provide airtightness features to the box as is known from the prior art, but if these recesses are offset relative an end wall fold line such as at a corner of the box an end wall fold line area is defined, wherein the pour opening can be provided in a way wherein the presence of the pour opening does not jeopardise the rigidity of the box. This is because the area outside said end wall fold line area A, which outside area is defined between the lines of adhesion retains its integrity and continues to provide sturdiness to the box even after it has been opened. This holds irrespective the kind of opening applied, which opening may be an opening which has one or more pre-weakened sections described above. In addition it has been found that at the same time the end wall fold line areas can be used to give some kind of form to the pour opening.

A variety of embodiments and variants now come within reach wherein for example the cardboard outer side is provided with an at least partial cut, and/or the material strip is provided with a perforation. If such a partial cut of the cardboard outer side crosses the perforation of the material strip there will be no danger that the airtightness gets lost. Either a single so called patch, wherein the material strip S at least covers a part of the end wall panels, at least at one end of the box may be applied, or a one patch is possible wherein the material strip S is formed in one part. In the latter case the cardboard inner side need not be coated or lined in order to prevent the substance in the box to come into contact with an unprotected part of the inner side of the cardboard.

In a further embodiment the method according to the invention is characterised in that an adhesive bead is positioned at the inside of the end wall panel over at least a part of the folded area with the material strip. Advantageously this further embodiment prevents contact to arise between the inner volume of the box and any other part of cardboard inner side which is not protected by the patch or material strip S. Simultaneously it also minimises the necessary adhesive line length to assure airtightness.

A still further method not necessarily limited to a method for manufacturing a box having airtight properties is characterised in that the end wall panel is provided with a seal that can be broken to expose the pour opening and that subsequent to opening the pour opening can be closed off by inserting the seal in the pour opening or under a relevant board layer. Advantageously the seal has a double function in that initially it seals and protects the pour opening and its surrounding area against clogging dust and dirt, whereas after being opened the pour opening can be closed off easily by means of the seal.

Still another embodiment of the method according to the invention is characterised in that the pour opening has a first pre-weakened section at the cardboard outer side, which first section is at least partially formed as a finger notch. After breaking the seal it will immediately be clear to the average person trying to open the box that such a finger notch has to be and can conveniently be pressed in in order to gain access to the substance therein.

In a single patch or multipatch airtight box the method according to the invention is furthermore characterised in that the pour opening has a second pre-weakened section at the strip material, which second section is formed by perforations running substantially from the place of the finger notch to the end wall fold line. After breaking the seal and pressing the finger notch, upon retracting the finger from the thus formed pour opening edge can be erected.

Still another embodiment of the method according to the invention is characterised in that the box is provided with a fold line extending substantially along the perpendicular bisector of the side wall panel. Advantageously it has been found further that by squeezing the box a forming of the pour opening edge arises such that a natural flow of substance streams out of the pour opening while the stream is being supported by the erected curved pour opening edge.

Furthermore the present invention relates to a box manufactured by the methods and to apparatus for manufacturing the box by applying the methods. In particular the invention is also directed to programmable control means which play an important role in the proper control of said apparatus and the means therein, and to software arranged to program the apparatus for performing the methods above.

At present the claimed inventions will be elucidated further together with their additional advantages, while reference is being made to the appended drawing, wherein similar components are being referred to by means of the same reference numerals. In the drawing:

BRIEF DESCRIPTION OF THE DRAWINGS

FIG. 2A shows a top plan view at one end of a prior art box; while

DETAILED DESCRIPTION OF THE INVENTION

Figure 1:
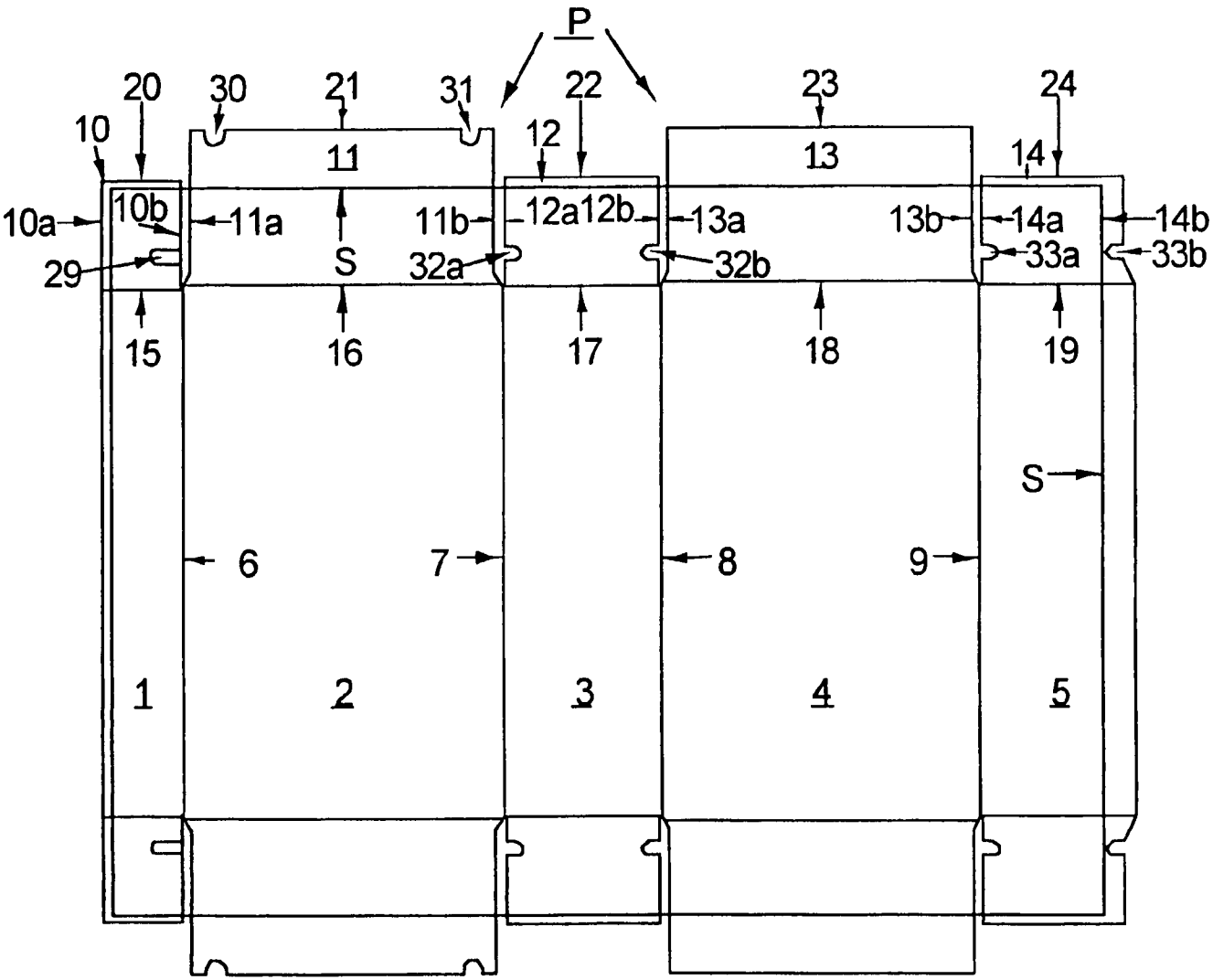
FIG. 1 shows a top plan view of a blank P.
Figure 2B:
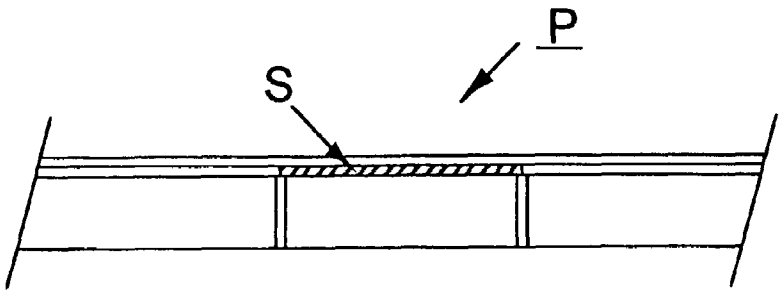
FIG. 2B shows a cross sectional view of FIG. 2A.
Figure 2A:
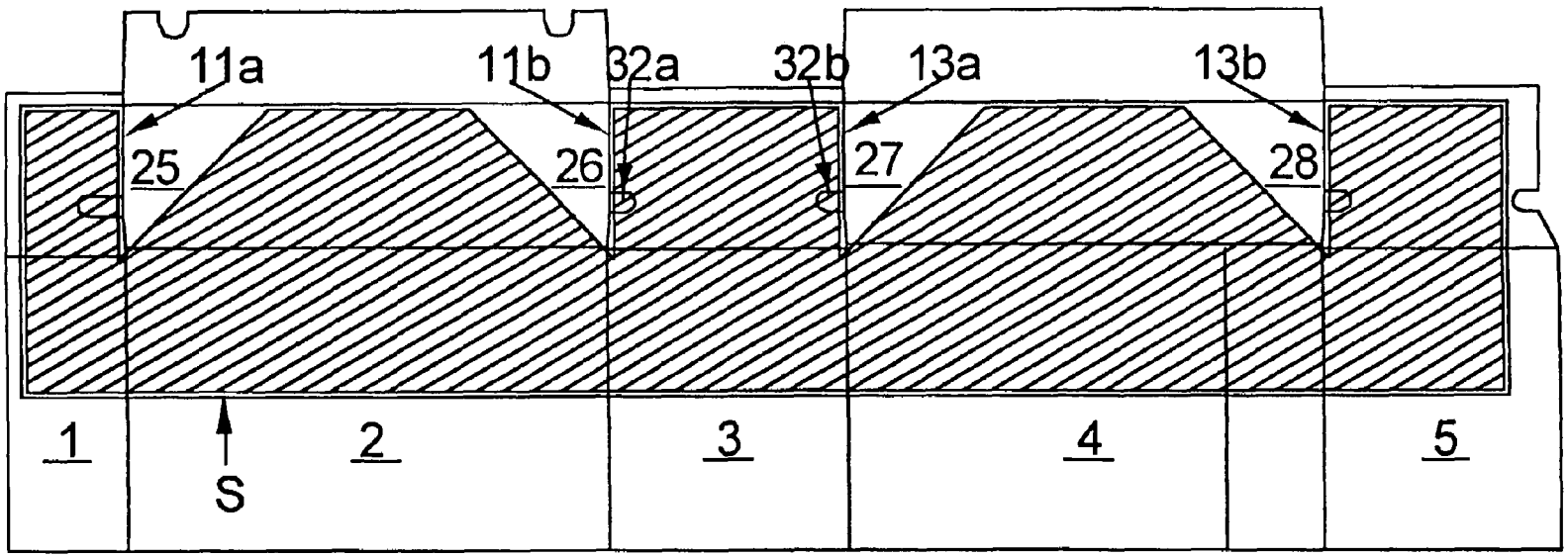
Figure 3:
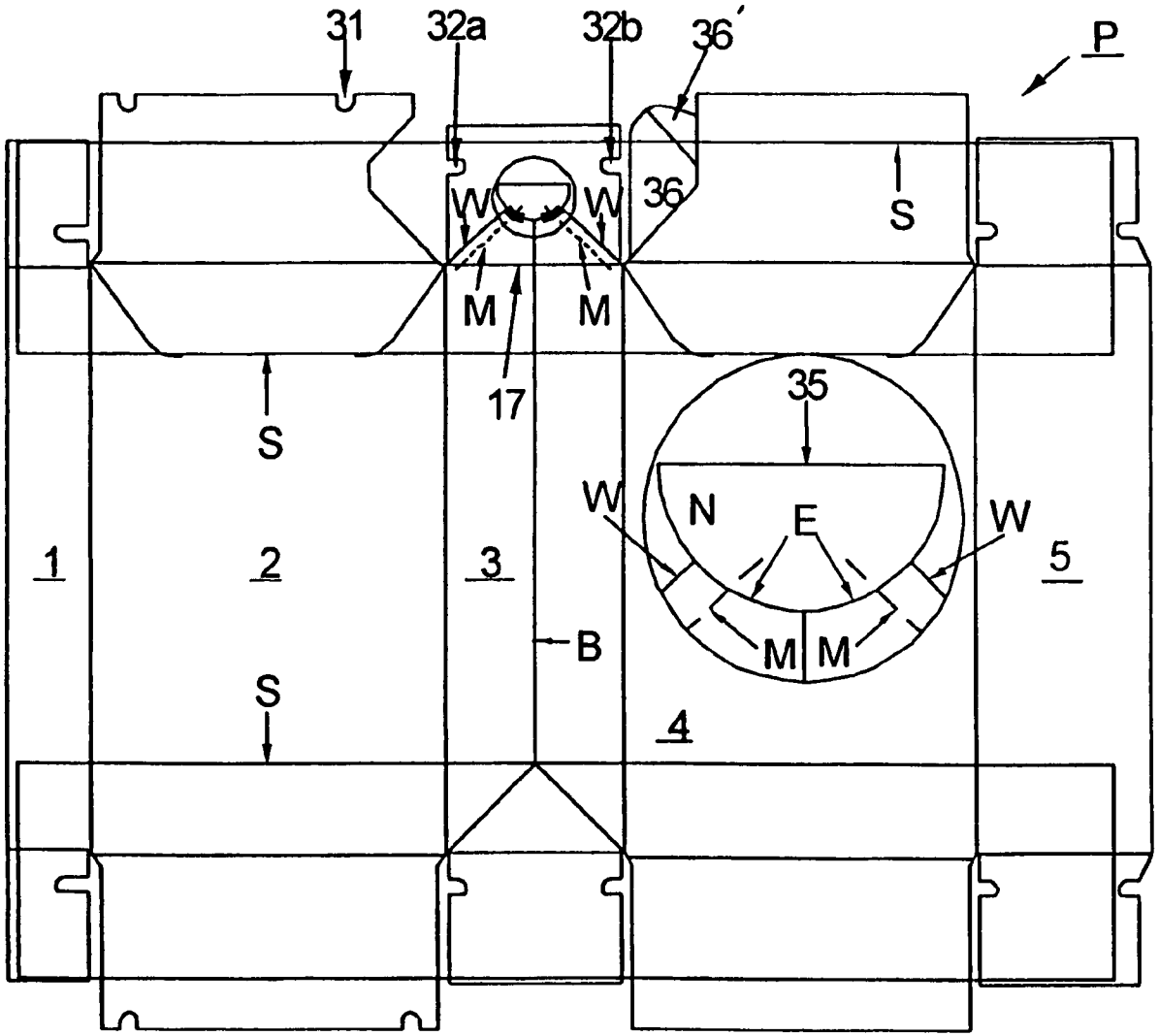
FIG. 3 shows a top plan view of a blank for manufacturing a box by the method according to the invention.
Figures 6A, 6B, 6C:
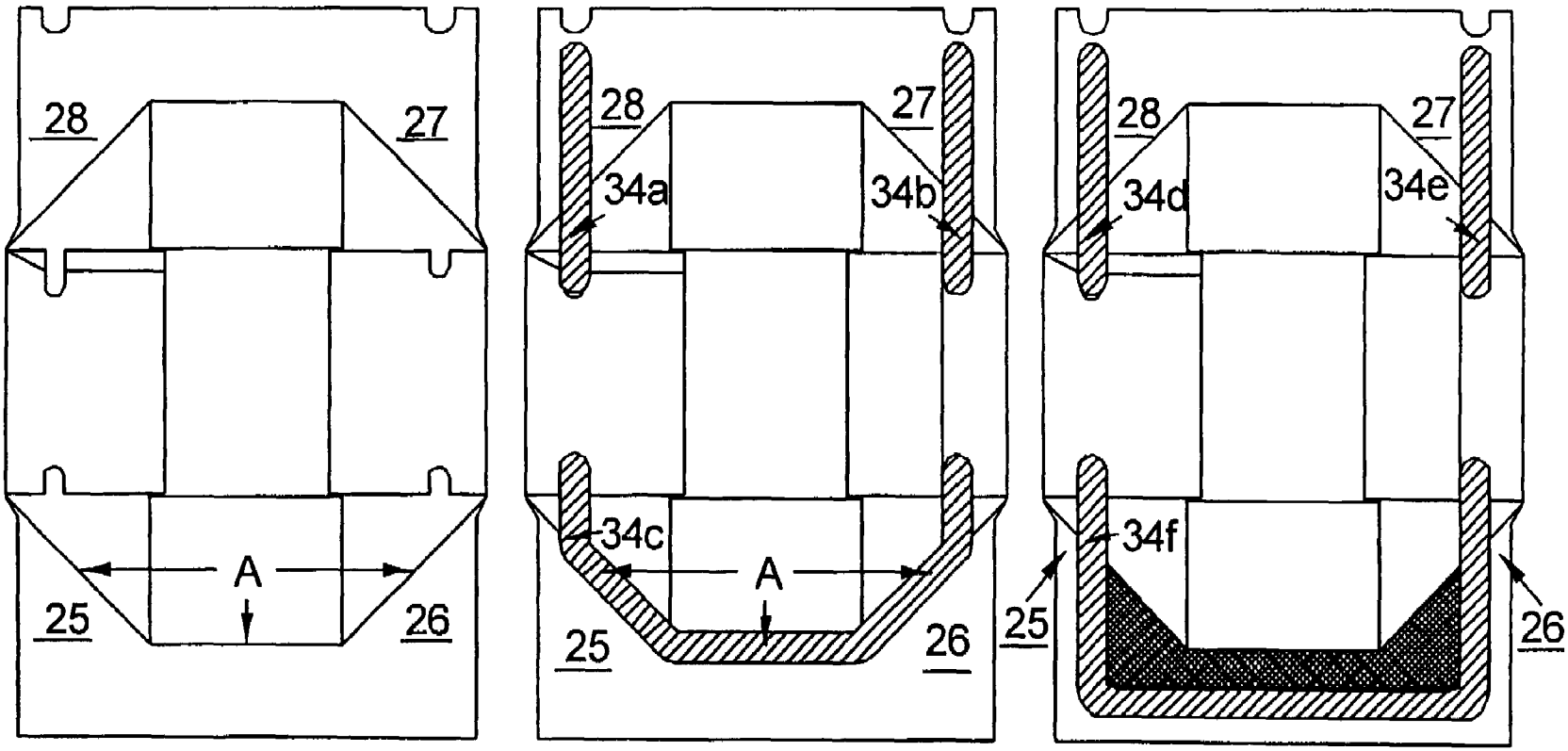
FIGS. 6A, 6B, and 6C show preferred glue line beads for the erected and partially folded blanks of FIGS. 1, 2A, and 3.

FIGS. 1, 2A, and 3 show a top plan view of a blank P, while FIG. 2B shows a cross sectional view of the blank P, which may be made from for example monolayered or multilayered cardboard, coated cardboard, laminate, plastic, synthetic or any other suitable packaging material. Examples of applicable coatings are: barrier coatings, water based coatings, etcetera. The blanks P comprise a number of side wall panels 1, 2, 3, 4, 5 which are mutually connected through side wall fold lines 6, 7, 8, 9. The blank further has a number of end wall panels 10, 11, 12, 13, 14 which are attached to the side wall panels 1-5 through end wall fold lines 15, 16, 17, 18, 19 respectively. The end wall panels 10-14 are each bounded by two opposite free edges 10*a*, 10*b*, 11*a*, 11*b*, 12*a*, 12*b*, 13*a*, 13*b*, 14*a*, 14*b* and a free end wall edge 20, 21, 22, 23, 24 located opposite the end wall fold line 15-19. After the blank P has been cut out as shown, at the location of one or more end wall fold lines 15-19 a flexible material strip S is connected at least partly with the side wall panels 1-5 and at least one of the end wall panels 10-14. The connection can be accomplished by means of any kind of bonding, such as for example by adhesion, sealing, lamination, all with or without the applying of energy, such as heat or radiation. The material strip S also called a patch may be a single patch or a multiplicity of separate patches, bonded at least to one bottom side or top side of the box. The strip S may for example be made of paper, such as metalised paper, whereby the paper may or may not be coated. The material strip S is also bonded to the other end wall panels 10-14, while leaving clear generally triangular portions 25, 26, 27, 28 (see also FIGS. 6A-6C) not provided with adhesive, located adjacent the free edges 11*a/b*, 13*a/b* of the corresponding end wall panels 11, 13. As shown in FIG. 1 recesses 29, 30, 31, 32*a*, 32*b*, 33*a*, 33*b* are provided in the free edges 10*b*, 21, 12*a/b*, 14*a/b* and in the end wall edge 21. The recesses 29-33 intersect possible leakage tunnels along which air, for example powdery substances, as well as insects and contamination can enter or exit the box interior. Starting from one or more recesses 29-33 glue dams or beads 34*a*-34*f*, as shown in FIGS. 6B and 6C, are provided in order to completely close off the box interior in a air tight way in case the box is closed, usually after having being filled. Reference is made here to applicants WO 97/32788, which is included here by reference thereto.

FIGS. 6B and 6C show possible glue line beads which are hatched, whereby in particular the lower bead 34*c* is placed at the inside of the end wall panel 23 over at least a part of the folded area with the folded material strip S. Relative to the path of the lower bead 34*f* in FIG. 6C the cross hatched area is exposed to the interior of the box without the material strip S protecting this inner part of the cardboard. This has an adverse effect on the airtightness of the box and may make it necessary to provide the inner side of the cardboard with a protective coating. The path of the bead 34*c* limits the interieur part of the box to an area which is protected by the material strip S. This makes the box cheaper. Furthermore a saving in the necessary amount of adhesive is realised, because the length of the adhesive path 34*c* is shorter than the length of the adhesive path 34*f*.

In practise it has been found that if the recesses 31, 32*a*, 32*b* of the box are offset away from fold line 17, and/or similarly if the recesses 30, 33*a*, 33*b* of the box are offset away from fold line 15, an end wall fold line area A arises. In FIG. 3 one such area A is detailed, wherein any kind of pour opening can be provided in a way wherein the integrity of the box in particular outside said area A is fully retained. In this description of the figures a box has thus far been described which has one or more patches S in order to make it airtight. The pour opening now to be described need not necessarily be applied in such a box having one or more patches S, but may well be used in a box not provided with any patch. In the latter case the box will not be airtight. Naturally an pour opening may also be provided outside said area A.

Figure 4:
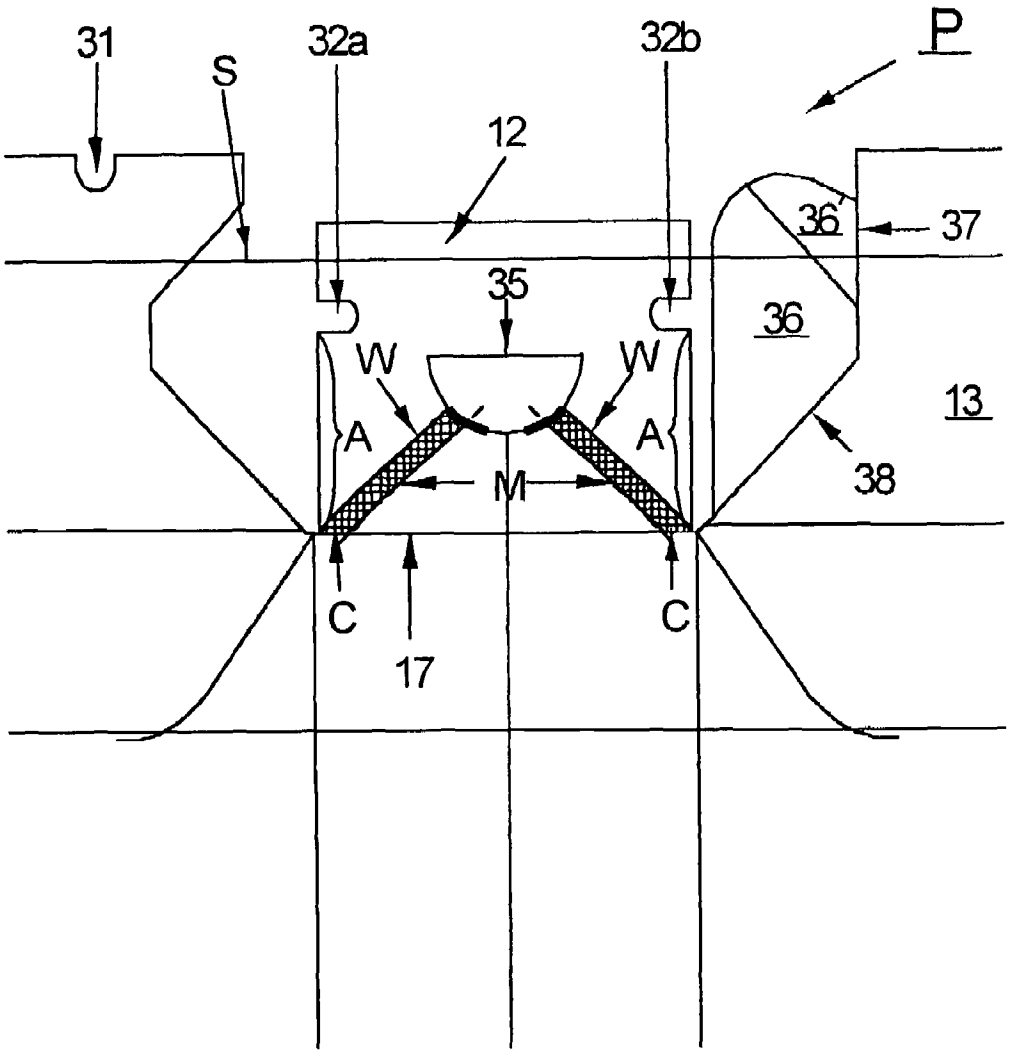
FIG. 4 shows in detail a possible embodiment of a pour opening in the box according to the invention.
Figure 5:
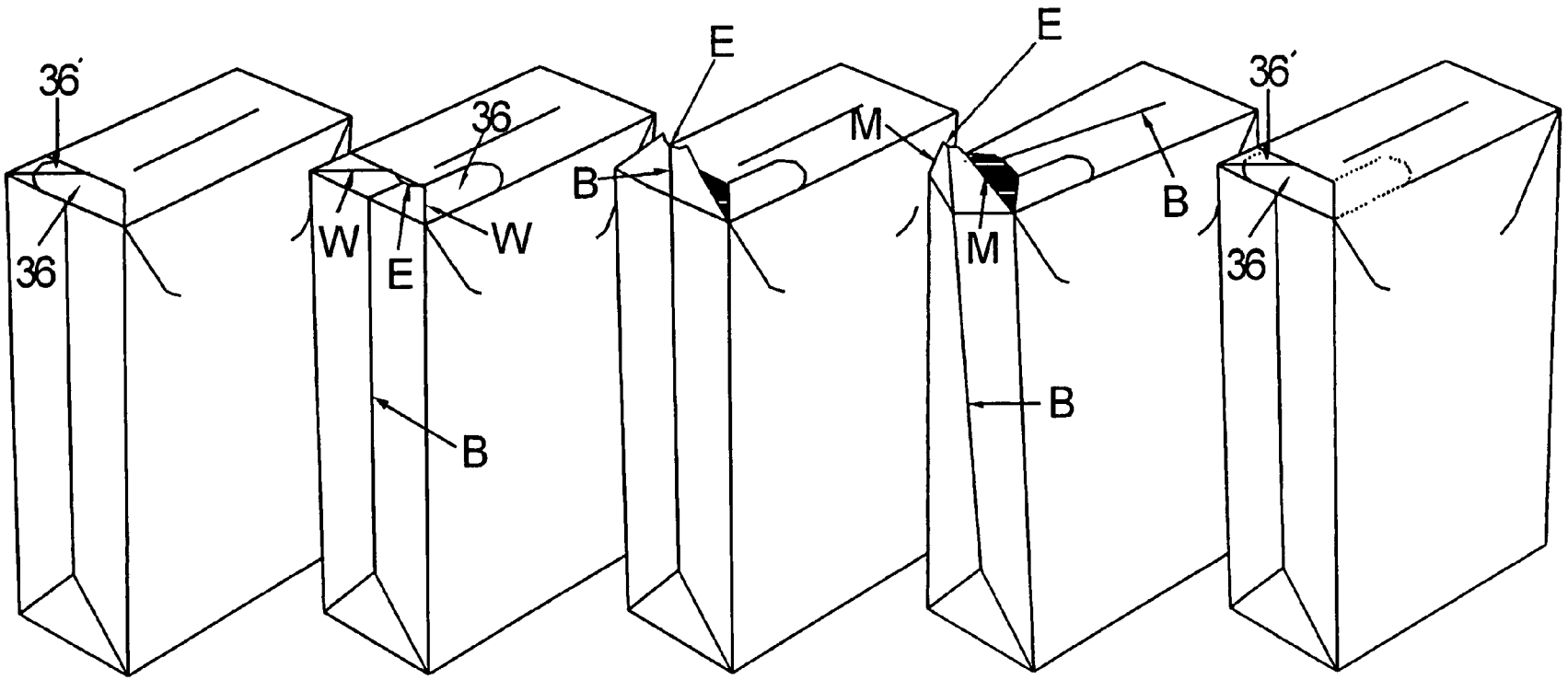
FIG. 5 shows a number of operational steps for creating a pour spout with the embodiment of FIG. 4.

FIGS. 3-5 give details about a pour opening 35, which is shown here to be provided in minor end wall panel 12. The particular pour opening 35 may be formed by partial cut lines—that is lines not all the way through—across the outer, print or the reverse side of the cardboard or blank P. In an airtight box having one or more patches the partial cut will not go all the way through the box material, in order not to jeopardise the airtightness characteristics of the box. In a box without patches this is less critical and the cut may go all the way through over a short distance. The pour opening 35 has a seal 36 on end wall panel 13, which seal may be broken by tearing it along a perforation 37, where after the seal 36 is hinged along line 38 to expose the pour opening 35. The pour opening as shown has a pre-weakened section in the form of a cut out finger or thumb notch N which may be pushed in the blank material, such as carton, in order to break the material strip S, for example made of paper which material is bonded to the reverse of the carton board of FIG. 3. The sequence of FIG. 5 shows the operational steps during the opening of the box. When the seal is broken a pour opening edge E is revealed which can be pushed in or pulled out from the carton along weakened lines W. Squeezing of the box substantially perpendicular to the side wall panels 2, 4 tends to form the pour opening edge E along a perpendicular bisector B in side wall panel 3 and 2, 4 to support an output flow of substance there through. Thereafter a slight pressing on side wall panels 1,5 and 3 urges the pour opening 35 back to its end wall panel 12 where after seal 36 closes off the opening 35. In particular seal part 36' slits under a line W in order to detachably cover the opening 35.

If the box is provided with one or more patches the material strip S is provided with a weakened section in the form of perforations M running from the finger notch N to the end wall fold line, indicated here with 17. In particular it may end in the vicinity of the respective corner points. The pre-weakened sections W and M in the box material and the material strip S respectively are offset spatially relative to one another. This will help delaminating and splitting up of materials in the area C, which is cross hatched in FIG. 4 and thus eases the breaking of the bond between these materials. Generally the pre-weakened sections may be made by perforations and/or partials cuts.

Figure 7:
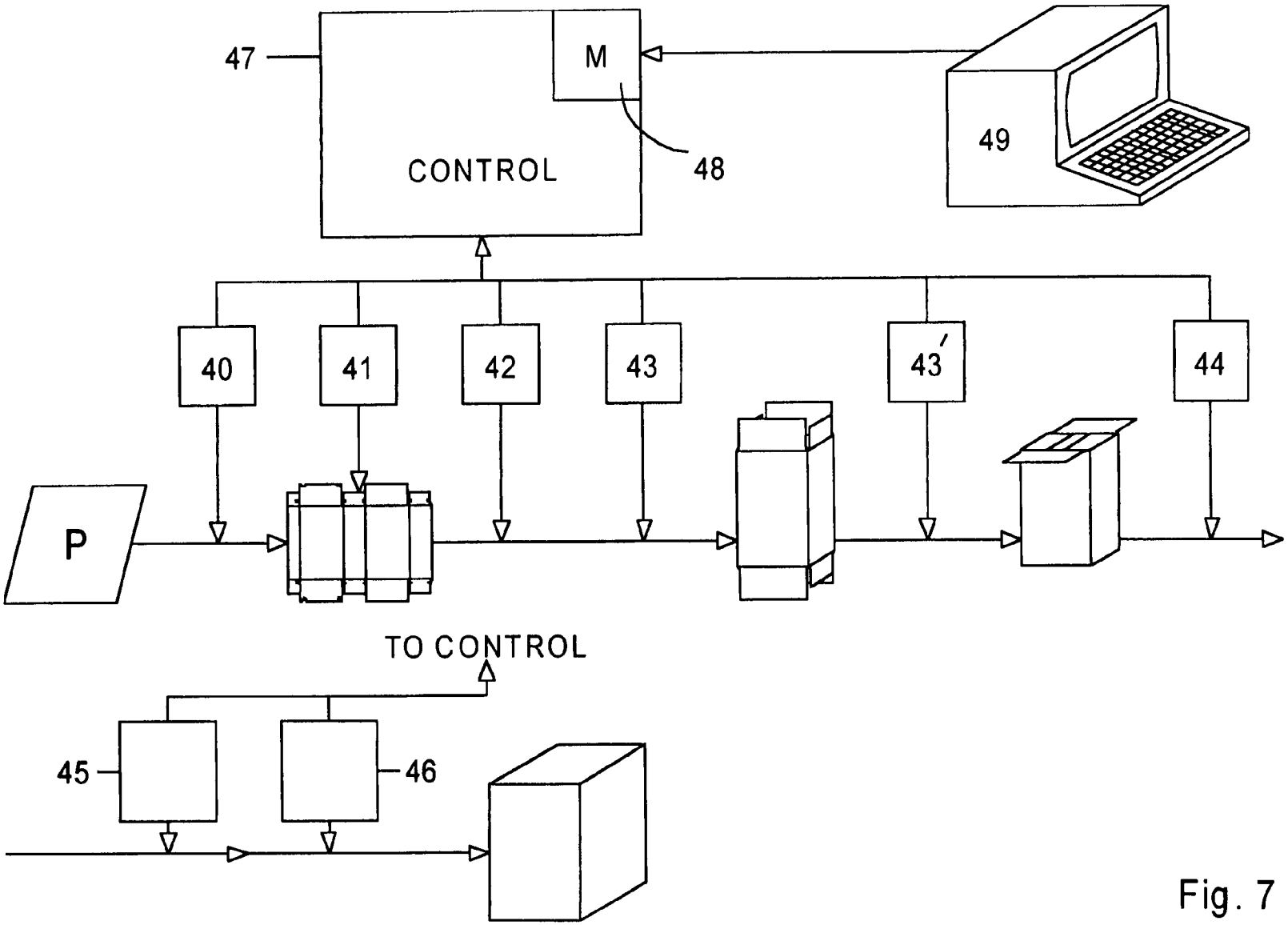
FIG. 7 shows a schematic representation of possible embodiments of several apparatus for performing the method according to the invention for manufacturing the box.

FIG. 7 shows a schematic representation of several apparatus for manufacturing the boxes by means of the method elucidated herein before. The apparatus 39 as shown comprises cutting means 40 for cutting the blank P; possibly but not necessarily patching means 41 for attaching one or more patches to the cut blank P; adhesion means 42 for applying glue beads; erecting means for folding and erecting the two sided open box; folding means 43 and 43' for folding and closing respectively one end of the box; filling means 44 for filling the box; adhesion means 45 for applying further glue beads; and folding means 46 for finally closing the filled box. All of these means 40-46 are coupled to control means 47 for controlling the operational manufacturing steps. Usually the apparatus is not installed at one place and the steps will generally be performed at different places and at different moments in time by different manufacturers/convertors. In all cases it is important that the control means 47 are properly programmed in order to be able to control not only the sequence of the operational steps, but also the exact positioning of in particular the cutting means 40 and the adhesion means 42 and 45. In order to be sufficiently flexible for the mass production of all kinds, shapes and sizes of boxes the control means 47 are programmable control means having a microprocessor 48. The microprocessor 48 can be loaded with software or programmed by means of for example a terminal 49.

It is to be noted that the description above only provides one way of carrying out the invention. The man skilled in the relevant art will be able to devise several variants of embodiments which will lie within his reach, without diverting from the accompanying claims.

The invention claimed is:

1. A method for manufacturing a box from a box material, wherein a blank is cut out, which includes side wall panels mutually interconnected through side wall fold lines, and end wall panels attached to the side wall panels by respective end wall fold lines, the method comprising:

bounding the end wall panels by two opposite free edges and a free end wall edge located opposite the respective end wall fold lines; attaching a flexible material strip at least to the end wall panels through bonding;

providing recesses in at least one of the end wall panels for exposing adhesive for attaching the flexible material strip to the corresponding end wall panel, and the adhesive for interconnecting the end wall panels, and the adhesives in communication at the recesses; and providing a pour opening in the box, wherein some of the recesses are offset away from their corresponding end wall fold line such that an end wall fold line area is defined between the end wall recesses and a fold line in which the pour opening is provided, wherein the recesses in the at least one end wall panel are offset away from an end wall fold line connecting the at least one end wall panel to a side wall and are offset away from a free end wall edge on the at least one end wall panel such that the recesses are disposed directly between the end wall fold line connecting the at least one end wall panel to a side wall and the free end wall edge on the at least one end wall panel.

2. A method for manufacturing a box from a box material, wherein a blank is cut out, which includes side wall panels mutually interconnected through side wall fold lines, and end wall panels attached to the side wall panels by respective end wall fold lines, the method comprising:

bounding the end wall panels by two opposite free edges and a free end wall edge located opposite the respective end wall fold lines;

attaching a flexible material strip at least to the end wall panels through bonding;

providing recesses in at least one of the end wall panels for exposing adhesive for attaching the flexible material strip to the corresponding end wall panel, and the adhesive for interconnecting the end wall panels, and the adhesives are in communication at the recesses; and providing a pour opening in the box, wherein at a place of the pour opening the box material and the flexible material strip are pre-weakened and at least a part of a pre-weakened section of the flexible material strip is offset in space relative to all pre-weakened section sections of the box material, and the recesses in the at least one end wall panel are offset away from an end wall fold line connecting the at least one end wall panel to a side wall and are offset away from a free end wall edge on the at least one end wall panel such that the recesses are disposed directly between the end wall fold line connecting the at least one end wall panel to a side wall and the free end wall edge on the at least one end wall panel.

3. The method according to claim 2, wherein the pre-weakening is performed by providing at least one of a perforation and an at least partial cut in the box material or flexible material strip.

4. The method according to claim 2, wherein outer or reverse sides of the box material are provided with at least a partial cut.

5. The method according to claim 2, wherein the flexible material strip is provided with a perforation.

6. The method according to claim 4, wherein the at least partial cut of the box material outer side crosses a perforation of the flexible material strip.

7. The method according to claim 2, wherein the flexible material strip at least covers a part of the end wall panels, at least at one end of the box.

8. The method according to claim 7, wherein the flexible material strip is formed in one part.

9. The method according to claim 7, wherein an adhesive bead is positioned at an inside of the end wall panel over at least a part of a folded area with the flexible material strip.

10. A box manufactured by the method according to claim 2.

* * * * *